US009850736B2

(12) United States Patent
Frazier

(10) Patent No.: US 9,850,736 B2
(45) Date of Patent: Dec. 26, 2017

(54) EXTENDED REACH PLUG

(71) Applicant: MAGNUM OIL TOOLS INTERNATIONAL, LTD., Corpus Christi, TX (US)

(72) Inventor: Warren Lynn Frazier, Corpus Christi, TX (US)

(73) Assignee: MAGNUM OIL TOOLS INTERNATIONAL, LTD, Corpus Christi, TX (US)

( * ) Notice: Subject to any disclaimer, the term of this patent is extended or adjusted under 35 U.S.C. 154(b) by 0 days.

(21) Appl. No.: 15/588,608

(22) Filed: May 6, 2017

(65) Prior Publication Data

US 2017/0241233 A1 Aug. 24, 2017

Related U.S. Application Data

(63) Continuation of application No. 14/999,637, filed on Jun. 9, 2016.

(51) Int. Cl.

| | |
|---|---|
| ***E21B 33/129*** | (2006.01) |
| ***E21B 33/124*** | (2006.01) |
| ***E21B 43/26*** | (2006.01) |
| ***E21B 43/14*** | (2006.01) |
| ***E21B 29/00*** | (2006.01) |
| ***E21B 33/12*** | (2006.01) |
| ***E21B 33/134*** | (2006.01) |

(52) U.S. Cl.

CPC ..... *E21B 33/1293* (2013.01); *E21B 29/00* (2013.01); *E21B 33/124* (2013.01); *E21B 33/1204* (2013.01); *E21B 33/134* (2013.01); *E21B 43/14* (2013.01); *E21B 43/26* (2013.01)

(58) Field of Classification Search

CPC ..... E21B 33/1204; E21B 33/134
USPC ..... 166/298, 369, 386, 387
See application file for complete search history.

(56) References Cited

U.S. PATENT DOCUMENTS

| | | | |
|---|---|---|---|
| 2,204,659 | A | 6/1940 | Burt |
| 2,714,932 | A | 8/1955 | Thompson |
| 3,687,196 | A | 8/1972 | Mullins |
| 4,176,715 | A | 12/1979 | Bigelow |
| 5,224,540 | A | 6/1993 | Streich |
| 5,472,049 | A | 12/1995 | Chaffee |
| 5,540,279 | A | 7/1996 | Branch |
| 5,669,448 | A | 9/1997 | Minthorn |
| 5,819,846 | A | 10/1998 | Bolt |
| 5,984,007 | A | 11/1999 | Yuan |

(Continued)

OTHER PUBLICATIONS

Thru-Tubing Systems, Inc. Wireline Products Catalog, pp cover sheet, 1, 13, 19, 20, 32, 36—publication revised Feb. 12, 2014 but contents earlier than Nov. 2011.

(Continued)

*Primary Examiner* — Robert E Fuller
*Assistant Examiner* — David Carroll
(74) *Attorney, Agent, or Firm* — G. Turner Moller

(57) ABSTRACT

A settable down hole tool is of increased drillability and/or of increased expansibility. The improvement in drillability can be caused by fracturing cast iron slips into a large number of small pieces that can be circulated out of a well without further reduction in size. The improvement in expansibility can be partially caused by providing an expander cone of increased hardness thereby allowing an increased angle on the expander cone and slips. The improvement in expansibility can be partially caused by increasing the thickness of the slips.

26 Claims, 5 Drawing Sheets

(56) References Cited

U.S. PATENT DOCUMENTS

| | | | |
|---|---|---|---|
| 6,167,963 | B1 | 1/2001 | McMahan |
| 6,394,184 | B2 | 5/2002 | Tolman |
| 6,578,633 | B2 | 6/2003 | Slup |
| 6,581,681 | B1 | 6/2003 | Zimmerman |
| 6,695,051 | B2 | 2/2004 | Smith |
| 6,769,491 | B2 | 8/2004 | Zimmerman |
| 6,796,376 | B2 | 9/2004 | Frazier |
| 7,228,908 | B2 | 6/2007 | East |
| 7,350,582 | B2 | 4/2008 | McKeachnie |
| 7,434,627 | B2 | 10/2008 | Turley |
| 7,478,676 | B2 | 1/2009 | East |
| 7,600,572 | B2 | 10/2009 | Slup |
| 7,681,654 | B1 | 3/2010 | Cugnet |
| 8,127,859 | B2 | 3/2012 | Allison |
| 8,496,052 | B2 | 7/2013 | Frazier |
| 2003/0188860 | A1 | 10/2003 | Zimmerman |
| 2004/0003928 | A1 | 1/2004 | Frazier |
| 2004/0045616 | A1 | 3/2004 | Cook |
| 2007/0074873 | A1 | 4/2007 | McKeachnie |
| 2007/0284109 | A1 | 12/2007 | East |
| 2008/0173453 | A1 | 7/2008 | Misselbrook |
| 2009/0211759 | A1 | 8/2009 | East |
| 2010/0263876 | A1 | 10/2010 | Frazier |
| 2010/0276159 | A1 | 11/2010 | Mailand |

OTHER PUBLICATIONS

Owens Oil Tools, pp. 4.0-4.1, last revised Sep. 2002.

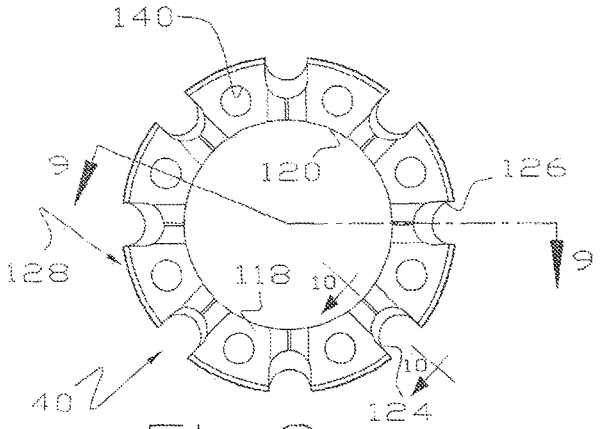
Fig.8
Fig.10
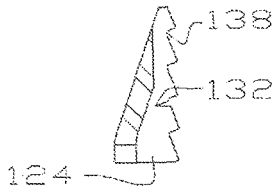
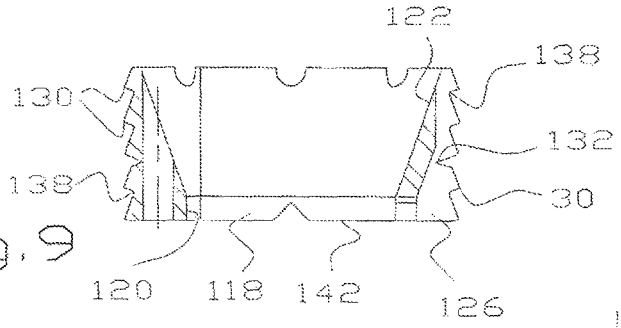
Fig.9
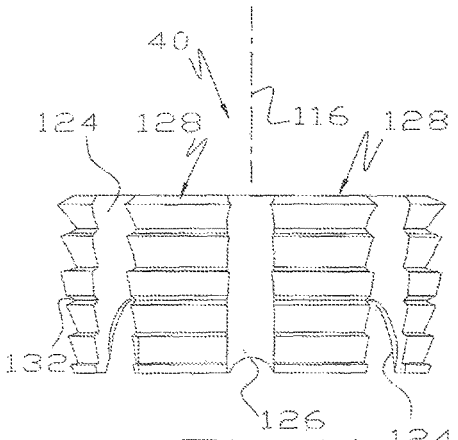
Fig.11
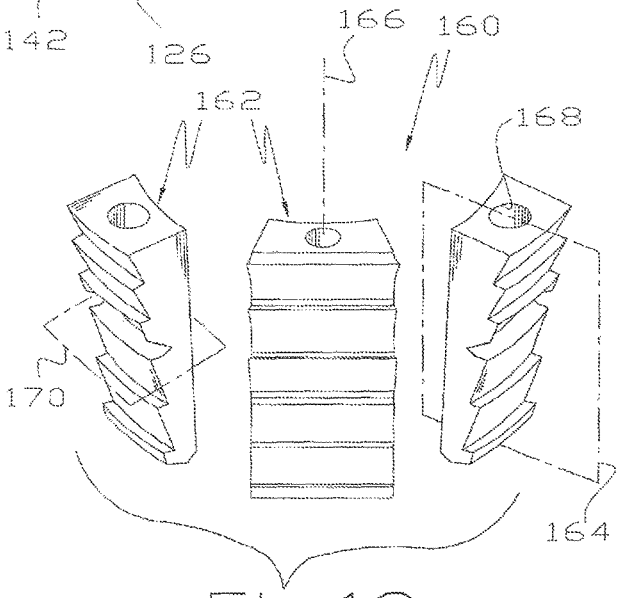
Fig.18

EXTENDED REACH PLUG

This application is a continuation of application Ser. No. 14/999,637, filed Jun. 19, 2016, which is, in turn, a continuation of application Ser. No. 13/373,223, filed Nov. 8, 2011, now U.S. Pat. No. 9,388,662.

This invention relates to a settable well tool used in wells extending into the earth and to slips used to wedge the well tool inside a pipe string.

BACKGROUND OF THE INVENTION

An important development in oil and gas production in recent decades has been the drilling of horizontal legs of hydrocarbon wells in combination with improvements in hydraulic or other types of fracturing techniques for stimulating production from previously uneconomically tight formations. For some years the fastest growing segment of gas production has been from shales or very silty zones that previously have not been considered economic. The current areas of increasing activity in the United States include the Barnett Shale, the Haynesville Shale, the Fayetteville Shale, the Marcellus Shale, the Eagle Ford Shale, the Bakken formation and other shale, or shaley formations. There are similar formations in other parts of the world.

It is no exaggeration to say that the future of natural gas production and perhaps the future of oil production in the onshore United States is from heretofore uneconomically tight hydrocarbon bearing formations, many of which are shales or shaley sixty zones. Accordingly, a development that reduces the cost of these type wells or increases cumulative production is welcome.

Currently, one procedure is to drill a horizontal leg through the productive formation, perform several frac jobs to generate vertical fractures at horizontally spaced locations along the horizontal leg of the well and produce the contents of the formation to the surface through conventional surface equipment. In order to frac a series of spaced locations in the horizontal leg, it may be necessary to set a bridge plug or other settable well tool to isolate the previously fraced zone from the next zone to be fraced. After all frac jobs are done, the settable well tools are removed, typically by drilling with a coiled tubing unit or with a work string and workover/completion rig.

There has been a trend to make bridge plugs and other drillable equipment from composite materials that can be more readily drilled than conventional cast iron. Thus, the only cast iron component of many currently available bridge plugs and other drillable downhole equipment is the slips that wedge the plug in the well. There has been a development of so-called "button" type slips that include a composite body having metal teeth embedded therein. These button slips are more easily drilled than conventional cast iron slips but there is a place for cast iron or other metal slips that are more easily drilled than current metal slips.

Cast iron metal slips are more time consuming to drill up when one has the luxury of a workover rig working in a vertical well where drill collars can be used to apply weight to the bit. It is considerably more tedious to drill up a bridge plug using cast iron slips in a horizontal well or using a coiled tubing unit where very little weight can be applied to the bit.

Shales or other tight formations completed in a horizontal well section have a history of rapidly declining production so an economic limit is reached sooner than desired. One proposed technique to continue producing such a well is to refrac the well at intervals between the original fractures.

This is currently accomplished by squeezing off the old fracture with cement, drilling out cement inside the casing string, reperforating the well between the old fractures and then refracing the well through the new perforations. The problem with squeezing off the old perforations is that one is never confident that the squeeze job won't fail at frac pressure in one or more of the perforations so frac fluid is diverted into an old fracture. If the original well had seven frac stages of four feet each with six perforations per foot, which is typical, there would be a total of a hundred sixty eight perforations to be squeezed. Expecting a squeeze job to hold over a hundred different perforations at frac pressures is a leap of faith.

It has been proposed to refrac old horizontal wells by setting a patch in the casing to cover the old perforations—a much more secure technique than squeezing with cement. After the casing patches are set, new perforations are sequentially created between the casing patches and the new perforations are sequentially traced. In order to isolate a zone that has been traced from the next zone to be traced in such a well, a bridge plug or similar tool is passed through the casing and casing patches to a location above the new perforations and then set against the casing. There are commercially available cast iron bridge plugs that are capable of passing through the reduced I.D. of a casing patch set in a casing string and then expanding into gripping and sealing engagement with the casing. Such cast iron bridge plugs are commercially available from all major oilfield service companies and have typically been used in vertical wells. In vertical wells, using a work over rig, a drill string and drill collars, enough weight can foe put on the cast iron bridge plug to drill it up in a reasonable length of time. The problem is it is difficult and slow to drill up a single cast iron bridge plug in a horizontal well segment where very little weight can be applied to the bit. To date, it has not been possible to drill up two or more cast iron bridge plugs in a horizontal well because debris from the upper bridge plug interferes with and prevents drilling up the lower bridge plug due, in large measure, because not much weight can be put on the bit. In addition, it has not been possible to drill up two or more cast iron bridge plugs in a single bit run in a horizontal well because the effort completely wears out bits.

Cast iron slips are typically manufactured in one or two relatively large pieces. When the tool is assembled; two piece slips are held together in some fashion so they act as a one piece device. When the tool is set in the well, the slips are forced onto an expander cone which fractures the slips into a series of segments that are trapped between the expander cone and the inside of the casing. In the past, the slip segments are of one piece and extend along the axis of the well. When the tool is drilled up in order to conduct another operation, the expander cone is drilled up thereby freeing the slip segments. Because the slip segments are so large, they must be either ground up by the bit and circulated out of the well or allowed to fall into the rat hole below the lowest perforations in the case of a vertical well. In the case of a horizontal well, large slip segments must be reduced in size by the bit or mill in order to circulate to the surface.

SUMMARY OF THE INVENTION

As disclosed herein, a settable well tool can be made of, or made mainly of, composite materials for increased drillability and can be of smaller O.D. than prior art tools and still be able to expand into setting engagement with a production string. This allows the set table well tool to pass through a section of the production string that is restricted for one reason or other.

In some situations, the heel or curved section of a horizontal well is more restricted than expected. This can occur because the drilled hole has dogleg sections that restrict the passage of tools of conventional O.D. This can also occur because the production string cemented in the well has become corrugated or ovate on the inside of the bend. Other examples will be apparent to those skilled in the art.

In some situations, the restriction in the production string is from a casing patch set over a damaged section of a production string or set over old perforations in the process of refracing an existing horizontal well. In this situation, the well tool described herein can pass through the reduced I.D. of the casing patch and then expand into gripping and sealing engagement with the inside of an unpatched section of the casing. It might be thought that one would simply duplicate the conventional cast iron bridge plug having this capability yet making the components of a composite material. This has not proven to be feasible.

In order to make a mainly composite bridge plug having this capability, it is necessary to increase the expansibility of the slips in a radial direction, i.e. perpendicular to the axis of the well. Conventional bridge plugs, as a practical matter, must have some range of expansibility because of the different wall thicknesses of well casing. For example, conventional 4½" O.D. casing comes in a variety of weights, e.g. from 9.5#/foot J-55 through 13.5#/foot N-80 to 15.1#/foot P-110, meaning they have the same O.D. but progressively smaller I.D. 's as the weight of the casing increases. Thus, as a practical matter, a conventional bridge plug passes through the heaviest wall I.D. pipe but must expand enough to wedge against the interior of the lightest wall I.D. pipe. By putting a casing patch inside oilfield casing, this problem is magnified or made worse because the tool can desirably pass through the inside a casing patch in the heaviest wall pipe and have the capability of expanding into gripping engagement with the inside of the lightest wall pipe. Table I shows an example of the reduction in thickness from casing patches in 4½" O.D. oilfield casing:

TABLE I

Example Using Conventional 4½" O.D. Oilfield Casing

| grade and weight/ft | I.D. in inches | casing patch thickness | I.D. of casing with patch |
|---|---|---|---|
| J-55 9.5# | 4.090 | .125" | 3.84" |
| N-80 11.6# | 4.000 | .125" | 3.75" |
| N-80 13.6# | 3.920 | .125" | 3.67" |
| P-110 13.5# | 3.920 | .125" | 3.67". |

There is an inherent variation in thickness and straightness of oilfield casing, meaning that anything run into a well has to accommodate normal manufacturing tolerances. Thus, a conventional bridge plug for use in 4½" casing has an O.D. of no more than about 3.75" meaning there is nominally about one quarter inch difference between the I.D. of typical 4½" casing and the O.D of the tool, meaning there is nominally a ⅛" clearance around the outside of the tool as it is being run into a well. It will be seen this is too small to run into a casing string having one or more casing patches or having some other type restriction in the casing. It will also be seen that conventional settable well tools do not have to expand much to grip the inside of the casing string in which they are run.

One technique to increase the expansibility of a well tool can be by increasing the angle and/or the length of the abutting composite expander cone, increasing the corresponding angle and/or length of the abutting face on the cast iron slips and/or increasing the thickness of the slips and reducing the O.D. of the mandrel. This proved unsuccessful. A close study of the problem revealed the cast iron slips either gouged into the composite cone during setting whereby the slips were not expanded sufficiently or, after setting, the composite expander cone extruded between gaps in the cast iron slips thereby allowing the slips to relax and retreat away from the inside of the casing and thereby lose their grip.

As explained more fully hereinafter, the hardness of the composite expander cone and the strength of the expander cone can be increased to avoid these problems. In one technique, a drillable metal skin can be provided on the exterior of the composite expander cone. In another technique, a drillable metal end can be provided for the expander cone. In another technique, a composite material having an increased hardness and strength may foe employed. Other techniques will be apparent to those skilled in the art.

In order to make a mainly composite bridge plug having substantially increased expansibility, the slips can be made thicker in order to provide greater expansibility of the slips. In one sense, this is counterintuitive and is clearly counterproductive because thicker cast iron slips are more difficult to drill up than conventional cast iron slips. In one aspect of the disclosed well tool, slips can be designed to fracture into much smaller pieces than conventional cast iron slips. These pieces can be small enough that they can be circulated out of a well without requiring further reduction in size. In other words, when a well tool equipped with the disclosed slips is being drilled, when the composite expander cones are drilled up, or mainly drilled up, the slip pieces are released from between the expander cone and the casing whereupon the pieces are simply circulated out of the well without further reduction in size. It is evident that slips of this design can be used on any settable well tool that can ultimately be drilled up, such as one that is not designed or intended to be ran through a casing patch or other restricted casing section. In other words, increasing the drillability of a settable well tool is desirable, regardless of whether the tool is run into a vertical or horizontal well, regardless of whether casing patches have been run into the well or regardless of whether there is a restriction in the casing.

The advantage of the disclosed composite settable tool may be viewed as increased expansibility of the settable tool. Typical prior art composite tools are capable of expanding on the order of ¼" in diameter. Thus, composite tools intended to work inside 4½" O.D. casing expand about 6% or so while tools intended to work inside 5½" O.D., casing expand about 5% or so. In contrast, some embodiments of the disclosed tool can expand at least 15% and preferably can expand considerably more, e.g. in the range of 20-25%, as will be more fully apparent hereinafter.

One object of this invention is to provide an improved composite settable well tool which can be drilled up more easily than prior art devices.

Another object of this invention is to provide an improved settable well tool which has increased expansibility, e.g. it can be run through casing having some type restriction therein.

It is an object of this invention to provide an improved composite bridge plug or other composite settable down hole tool that can be run through casing having a patch therein.

Another object of this invention is to provide improved slips for wedging a down hole tool in a well where the slips fracture into relatively small pieces in the act of setting the slips.

These and other objects and advantages of this invention will become more apparent as this description proceeds, reference being made to the accompanying drawings and appended claims.

BRIEF DESCRIPTION OF THE DRAWINGS

FIG. 8 is an end view of slips used in the well tool of FIG. 3;

FIG. 9 is a cross-sectional view of the slips of FIG. 8, taken substantially along line 9-9 thereof as viewed in the direction indicated by the arrows;

FIG. 10 is a cross-sectional view of the slips of FIG. 7, taken substantially along line 10-10 thereof as viewed in the direction indicated by the arrows;

FIG. 11 is a side view of the slips of FIGS. 8 and 9;

FIG. 18 is a partial isometric view of another embodiment of a set of slips.

DETAILED DESCRIPTION

The present invention relates to devices for use in hydrocarbon wells drilled into the earth and completed using a variety of techniques. The materials from which the tools are made are subject to considerable variation. Some of the components can be of drillable metal and some can be of composite material. A composite material can be a fabric core impregnated with a resin which is hardened in some suitable manner. Any components left in the well are usually made of drillable materials. Various changes and adaptations can be made in the tools without departing from the spirit and scope of the invention, which is to be measured solely by the claims themselves.

Figure 2:
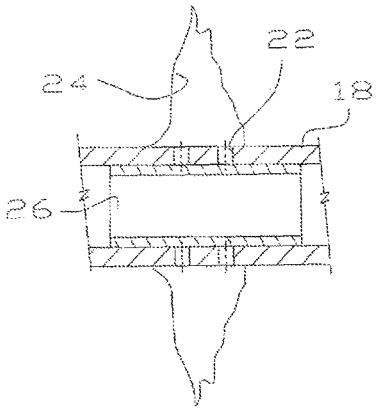
FIG. 2 is an enlarged view of a well section where a casing patch has been placed over an existing set of perforations.
Figure 1:
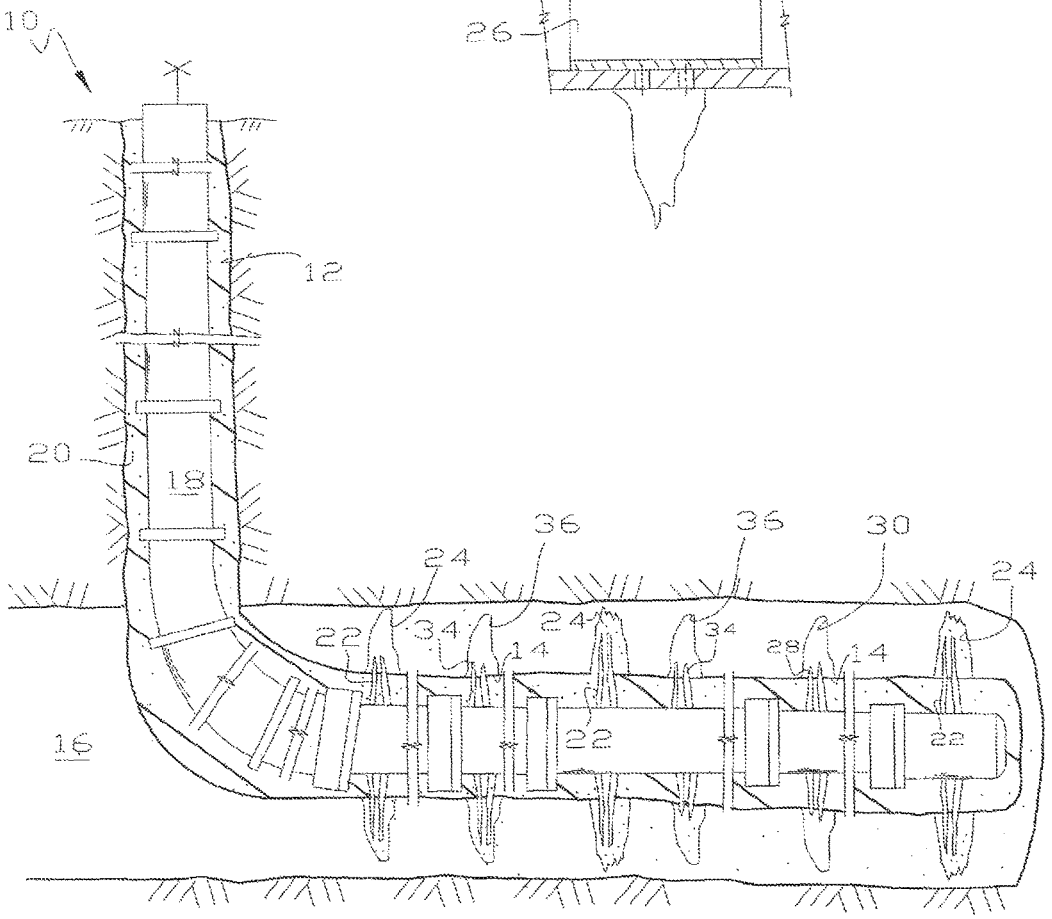
FIG. 1 is a diagrammatic view of a horizontal well showing a set of perforations which have been fraced.

Referring to FIGS. 1-2, there is illustrated a hydrocarbon well 10 having a vertical well bore section 12 and a horizontal well bore section 14. The horizontal well bore section 14 can extend through a hydrocarbon bearing formation 16. A casing string 18 can be cemented in the well bore sections 12, 14 by a cement sheath 20. The well 10 is illustrated as being a well that has already produced through a series of perforations 22 which were stimulated by a frac job to provide a series of fractures 24. In some situations, production from the well 10 can decline to an extent where it can be desirable to blank off the existing perforations 22 and fractures 24 and produce one or more new fractures.

The goal is to blank off the old perforations 22 and old fractures 24, perforate a section between the old perforations 22 or beyond the most distant perforations and frac the new perforations. To this end, FIG. 2 shows a casing patch 26 that has been run into the well 10 and expanded in a conventional manner to blank off the perforations 22 and the fracture 24. Casing patches are conventional equipment and are available from Owen Oil Tools, Weatherford International, Baker Hughes Incorporated and various independent oil field service companies. Conventional casing patches are tubular and typically include an inner metal layer and a thin outer rubber or resilient layer. The patches initially have an O.D. slightly less than the I.D. of the casing into which they are run. When the patch is positioned at its desired location, a swedge is pulled through the patch stretching the patch beyond the elastic limit of the metal layer and forcing the patch against the inside of the casing. Because the metal layer is stretched beyond its elastic limit, the patch remains against the casing and does not relax to its original O.D. As mentioned, the difficulty is that the thickness of the casing patch reduces the I.D. of the casing string 18 and thereby complicates expanding a settable well tool against the inside of the casing string 18.

Typically, a series of casing patches can be run into the well 10 and set across all existing perforations. Then, a first set of new perforations can be created at the most distant location from the surface, the first set of new perforations is traced to produce a first fracture and a bridge plug is set near the first new fracture to seal it off temporarily. This process is repeated as many times as desired to produce a series of new fractures which hopefully will reestablish commercial production from the well 10. This process is illustrated in FIGS. 1-2 where the old perforations 22 are blanked off, a new set of perforations 28 are created and then fraced to produce a new fracture 30.

To this end, a settable tool 32 which is illustrated as a bridge plug can be run above the first new set of perforations 28 in order to shoot a second set of perforations 34 and frac through them to create a second new fracture 36. The bridge plug 32 is illustrated as being of the type shown in U.S. patent application Ser. No. 12/317,497, filed Dec. 23, 2008, which is incorporated herein by reference for a more complete description thereof. The bridge plug 32 can comprise a mandrel 38, a pair of slips 40, 42 which may be identical, a pair of expanders or expander cones 44, 46 which may be identical, an expandable seal 48, a muleshoe 50 and a setting assembly 52 including a reaction ring 54 abutting the upper slips 40 and a sliding sleeve 56.

In most applications, the settable tool 32 can be made of drillable materials. The mandrel 30, the slip expanders 44, 46, the tube 56, the muleshoe 50, the reaction ring 54 are made of drillable materials selected from the group consisting essentially of aluminum, aluminum alloys, copper, copper alloys and composites. The strength and hardness of a composite depends on the fabric material, the resin employed and the conditions under which the composite is manufactured. Composites can be made in a wide range of strengths and hardnesses, many of which are drillable. The seal 48 is typically of rubber and the slips 40, 44 may be of cast iron.

In use, a wire line or other setting tool (not shown) is threaded onto a connection 58 and including a sleeve (not shown) abutting the sleeve 56. By pulling up on the connection 58 and pushing down on the sleeve 56, the reaction ring 54 pushes against the upper slips 40. The expander cones 44, 46 are ultimately driven into the slips 40, 42. The slips 40, 42 are fractured as explained more fully hereinafter and expand into engagement with the interior of the casing string 18 thereby wedging the bridge plug 32 securely against the inside of the casing string 18. The seal 48 also expands against the inside of the casing 18 thereby providing a pressure seal. As heretofore described, those skilled in the art will recognize that the sett able tool 32 is set inside the casing 18 in a more-or-less conventional manner.

As explained previously, the settable tool 32 is capable of being run through the casing patch 26 or other restriction and then expanded into gripping engagement with the inside of the casing string 18. Prior art expander cones are made of a composite material or engineered plastic. These type materials can comprise a fabric impregnated with a resin which is then cured to form a blank which is then machined into a desired shape. One modification of the settable tool 32 that facilitates increased expansibility is the design of the expander cones 44, 46. Simply increasing the angle of the frustoconical surface 60 of the cones 44, 46 and the complementary surface in the slips 40, 42 did not work. With conventional east iron slips, the slips did not expand sufficiently to grip light weight casing while being able to pass through a casing patch in heavy wall casing. Conventional cast iron slips are, of course, made as thin and lightweight as possible because the tools they are used with commonly need to be drilled up to prepare for a subsequent well operation. In addition, in some situations, the surface of the cone extruded between the segments of the slips during setting of the tool thereby failing to expand the slips sufficiently. In other situations, the slips were expanded sufficiently at the outset but the cones later extruded between the slip segments thereby allowing the slips to relax and retract away from the casing wall thereby inappropriately releasing the settable tool, from the casing.

Figure 4:
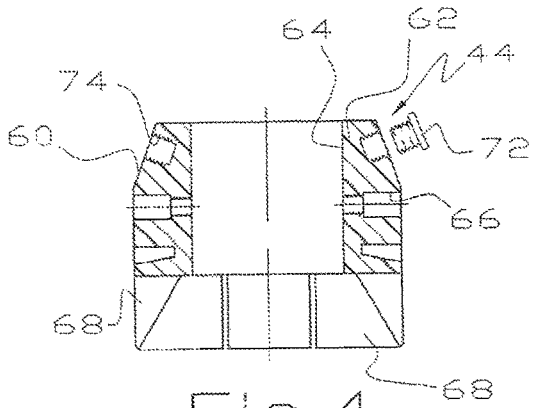
FIG. 4 is a cross-sectional view of an expander cone used in the well tool of FIG. 3, the cross-section being taken along line 4-4 of FIG. 7 as viewed in the direction indicated by the arrows.

In the embodiment of FIG. 4, the expander cone 44 is considerably harder, at least in the area of the surface 60, than is conventional. Conventional composite materials used in well tools, i.e. fiberglass impregnated with a standard plastic resin, has a Rockwell B hardness in the range of 45-50. These materials have been proven to fail when used as an expander cone in an extended reach well tool. In some embodiments of the expander cone 40, the hardness of the composite frustoconical surface 60 is at least 70 on the Rockwell B scale and preferably is at least 80 which, in the right situation, can be sufficient to prevent extruding the expander cone between the slip segments. The ability of the expander cone to withstand the forces of an extended reach tool may depend an other factors such as tensile or compressive strength, meaning the higher the better.

Increasing the angle of the surface 60 and increasing the hardness of the surface 60 provides a partial solution to increased expansibility and, in one approach, one might increase the expansibility of settable well tools without providing a single device that would operate over the entire range necessary for operation in a specific sized casing. For example, one might provide two slightly different tools for operation in 5½" casing, e.g. one tool for 5½" casing weighing 15.5#-17#/foot and a second tool for 5½" casing weighing 20-26#/foot. In situations like this, one could design a tool using a high angle expandable cone of increased hardness to provide the increased expansibility.

The expander 44 can otherwise be of conventional shape and can comprise a body 62 having a central passage 64 and one or more set screw passages 66 for securing the expander cone 44 to the mandrel 30. The bottom of the expander cone 44 includes a series of tapered segments 68 which receive the seal 48. When the tool 32 is set against the casing 18, the segments 68 can act like flower petals and constrain movement of the seal 48 into sealing engagement with the casing 18. In some high pressure situations, a metal cone can be provided to further constrain movement of the seal. The cone 44 can be scored to split and thereby create the segments 68 in an appropriate manner during expansion of the seal 48.

To promote reliable fracturing of the slips 40, 42, a guide or series of guides 72 may be provided that will act in a manner to be disclosed more fully hereinafter. The guides 72 can comprise a pin glued in a blind passage 74, can comprise a set screw threaded into the passage 74 or can comprise any mechanism providing an abutment or shoulder 76 extending above the conical surface 60.

Figure 5:
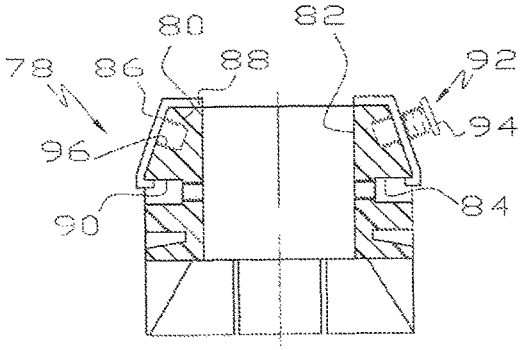
FIG. 5 is a cross-sectional view of an expander cone made of a composite material having a drillable metal layer on the cone.
Figure 7:
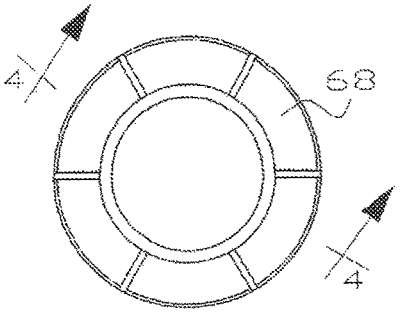
FIG. 7 is an end view of the expander cones of FIGS. 4-6.

Referring to FIG. 5, another embodiment 78 of an expander cone is illustrated and can comprise a body 80 having a central passage 82 and one or more set screw passages 84 for securing the expander 78 to the mandrel 38. The body 80 can be of a conventional composite material, i.e. having conventional hardness, and can be equipped with a sleeve 86 or layer of drillable metal such as aluminum and aluminum alloys, copper and copper alloys such as brass or bronze and the like. The bottom of the expander 78 can be of the same style and shape as that of the expander 44. The sleeve 86 can have turned ends 88, 90 captivating the sleeve 86 to the expander body 80. In this manner, the hardness of the conical upper end of the expander body 30 can be increased. The expander 78 may also be provided with a guide or series of guides 92 comprising a pin or set screw 94 in a blind passage 96.

Figure 6:
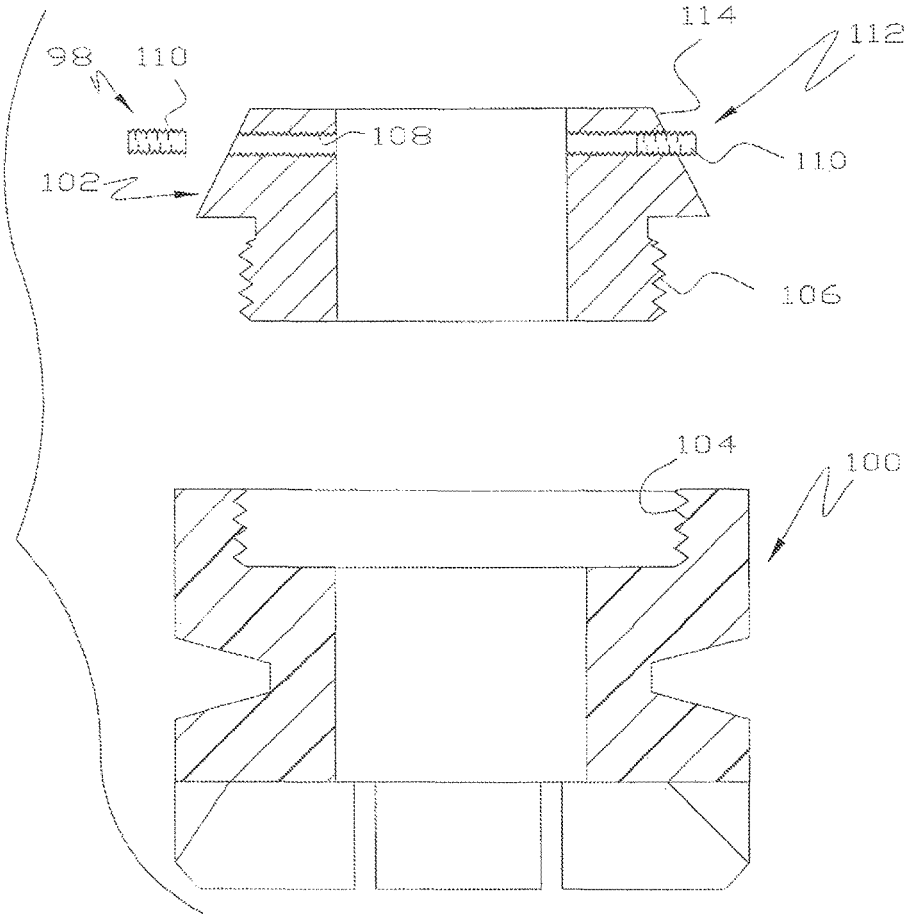
FIG. 6 is a cross-sectional view of another embodiment of an expander cone.

Referring to FIG. 6, there is illustrated another embodiment of an expander 98 having a one end 100 of a composite material and a conical end section 102 of a drillable metal such as aluminum, aluminum alloys, copper, copper alloys and the like. The end 100 can be shaped and configured as in the expander 44 having a threaded connection 104 for receiving threads 106 provided by the metal end section 102. One or the other of the sections 100, 102 may have passages 108 for receiving set screws 110 to fix the expander 98 to the mandrel 38. The expander 98 can have a guide or series of guides 112 on the conical surface 114 to promote reliable fracturing of the slips 40 as explained more fully hereinafter. If desired, the function of the guides 112 can be accomplished by selecting the set screws 110 to extend beyond the conical surface 114 as will become more fully apparent hereinafter.

Another approach to increase the expansibility of the settable well tool 32 is to increase the thickness of the cast iron slips. This is counterintuitive because it is often desirable to drill up settable well tools and thicker cast iron slips segments are much harder to drill up, meaning that one has traded one large advantage for one large disadvantage.

Upon expansion of the well tool into engagement with the casing, the slips move relative to the expanders. Because the slips are made with a series of external grooves parallel to the tool axis 116, the slips fracture into a series of substantially identical elongate slip segments which are parallel to the tool axis 116. When conventional cast iron slips are thickened in an attempt to increase the expansibility of a well tool, the well tool inherently becomes more difficult to drill up.

To avoid this disadvantage, the slips 40, 42 are designed to fracture into an unusually large number of pieces. Standard cast iron slips fracture into a number of elongate slip segments corresponding to the number of external grooves that promote fracturing. Thus, conventional cast iron slips typically comprise six or eight grooves causing the slips to fracture into six or eight elongate slip segments. As disclosed herein, the slips 40, 42 also fracture into a series of elongate slip segments and each slip segment can further fractured into at least two pieces and may preferably be fractured into at least four pieces. It is believed that fracturing first occurs along the external grooves but it is not material in which order fracturing occurs. The important thing is that the slips are reduced during setting of the well tool to a much larger number of pieces. Because there are more slip pieces, each slip piece weighs much less than conventional slip pieces, meaning they are much easier to circulate out of the well without much, if any, drilling of the pieces.

Reducing the slips to pieces that are much smaller and lighter is accomplished by providing additional zones of weakness that induce fracturing when the slips 40, 42 are being expanded by the expanders 44, 46. Some of these zones of weakness may be parallel to the tool axis 116 and some may be transverse to the tool axis 116. As shown in FIGS. 8-16, the slips 40 include a body 118 that may be of one piece but which may be multipiece that is held together by a suitable mechanism in the retracted position shown in FIG. 3. The slip body 118 includes a central passage 120 having a tapered or conical surface 122 which is at a complementary angle to the conical surfaces 60, 86, 114 of the expanders 44, 78, 98.

The slip body 118 can include a series of grooves 124, 126 which can be on the exterior of the slips and which can divide the slips into a series of more-or-less identical slip segments 128. In some embodiments, some of the grooves 124 may be considerably deeper or more pronounced than alternate grooves 126. This is believed to cause fracturing along the grooves 124 first but the order in which fracturing occurs is not material. It will be seen that the grooves 124, 126 produce zones of weakness parallel to the tool axis 116.

Figure 14:
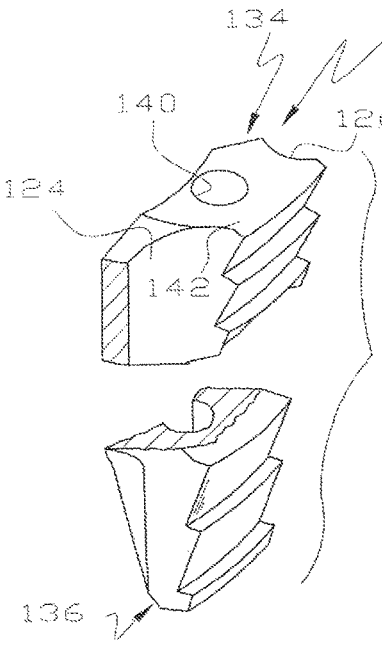
FIG. 14 Is an isometric view of the slip segment of FIGS. 12-13 after it has been fractured along a zone of weakness perpendicular to the tool axis.
Figure 12:
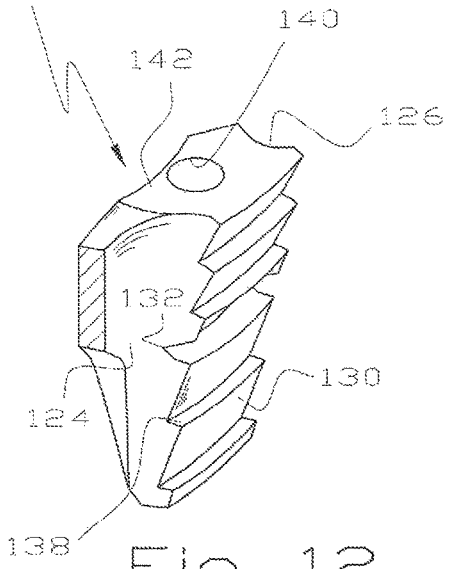
FIG. 12 is an isometric view of a slip segment following fracturing of the slips into a series of segments.
Figure 13:
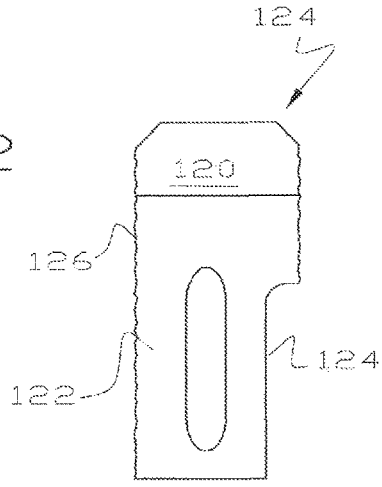
FIG. 13 is a back view of the slip segment of FIG. 12.

Each of the slip segments 128 includes teeth or wickers 130 on the exterior that grip the casing 18 when the slips 40 are expanded. It may be preferred to heat treat the slips 40, 42 so that only the surface of the wickers 130 is hardened. Some or all of the slip segments 128 can include a second zone of weakness or notch 132 transverse to the tool axis 116 which causes the slip segment 128 to fracture into upper and lower halves 134, 136 as shown in FIG. 14. As shown best in FIG. 11, the notches 132 lie in a common plane. The notch or crease 132 is distinct from the inside edge or inside I.D. 138 of the teeth 130 because conventional east iron slips do not fracture at the edge 138. In this device, the notches 132 may be coincident with one of the tooth edges 138 and, in the illustrated embodiment, are very close to one of the tooth edges 138. The second zone of weakness 132 accordingly divides the slip segment 128 into two pieces.

As will be explained more fully hereinafter, the segment halves 134, 136 may vary in the range of ⅓ to ⅔rds of the weight of the slip segment 128 and may preferably each be about half the weight of the slip segment 128. Another relevant characteristic is the tendency of the segment halves 134, 136 to fall by gravity through an upwardly moving body of liquid. The segment halves 134, 136 may preferably be equally propelled upwardly in a column of moving liquid so they may be circulated out of a well with little or no additional reduction in size, as from drilling. Thus, the location of the notch or crease 132 may vary considerably along the long dimension of the slip segment 128. It will be seen that the slips 40, 42 can be wholly of metal, or may comprise non-metallic inclusions but, in any event, the metal of the slips 40, 42 is continuous and provides the structural strength and integrity of the slips 40, 42.

A more sophisticated approach is to determine a cross-sectional parameter of the upper and lower segment halves 134, 136 that is related to their movement in an upwardly moving column of liquid. This parameter and the weight of the segment halves may be combined to provide an optimum location for the crease 132.

As shown best in FIGS. 8, 12, 14 and 15, some or all of the slip segments 128 provide a third zone of weakness or passage 140 opening between the conical surface 122 and an end 142 of the slip body 118. Although the passage 140 is conveniently illustrated as a cylindrical hole, it may be of any desired shape. The third zone of weakness can accordingly be generally parallel to the tool axis 116. During setting of the slips 40, the slip segment halves 134, 136 can divide roughly into mirror imagine halves 144, 146, meaning that each slip segment 128 has the potential to divide into four slip pieces.

It will be apparent that the slip segments 128 can include multiple horizontal creases or notches 132 thereby dividing the slip segments 128 into more than two horizontal pieces. In addition, the slip segments 128 can include multiple zones of weakness parallel to the tool axis thereby dividing the slip segments 128 into more than two vertical pieces.

Setting of the well tool 32 will now be described. The tool 32 can be run on wireline and can be conveyed by slickline or wireline and can be dropped, pumped or run on coiled tubing into the well 10. When it reaches its desired location, a setting tool (not shown) pulls on the connection 58 and pushes on the reaction ring 54. This causes the mandrel 38 to move upwardly in FIG. 3 so the expanders 44, 46 move into the central passages of the slips 40, 42. In the expanded position of the tool 32, the guides 92 can be located in or near the entrance to the grooves 124, 126 so the guides 92 enter the grooves 124, 126 and guide the slips 40, 42 in a predictable manner toward the expanders 44, 46. This can prevent the slips 40, 42 from fracturing only on one side thereby preventing the slips 40, 42 from clamshelling.

Figure 15:
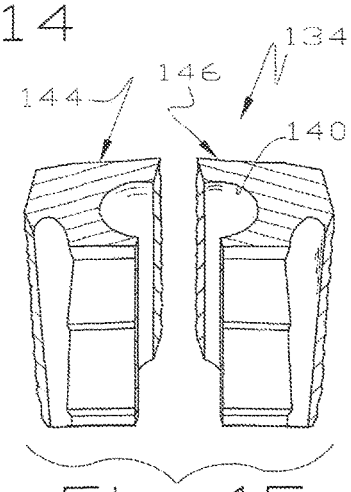
FIG. 15 is an isometric view of the upper half of the slip segment of FIG. 14 after it has been fractured along a second zone of weakness parallel to the tool axis.
Figure 16:
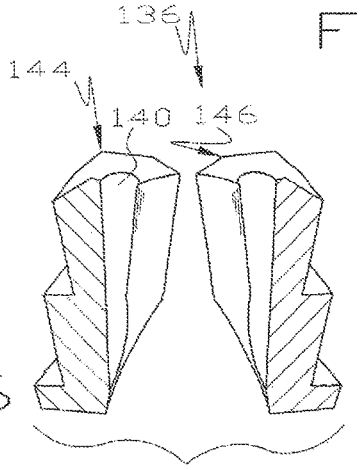
FIG. 16 is an isometric view of the lower half of the slip segment of FIG. 14 after it has been fractured along a second zone of weakness parallel to the tool axis.

Continued pulling on the connection 58 causes the expanders 44, 46 to nest further in the slips 40, 42. Soon, the slips 40, 42 fracture along zones of weakness provided by the grooves 124, 126. It is believed the larger grooves 124 fracture first although the sequence or order of fracturing is not material. This produces the series of separate slip segments 128. Continued pulling on the connection 58 causes the expanders 44, 46 to nest further in the slips 40, 42. Shortly, the slip segments 128 can fracture to produce the pieces 134, 136 and the pieces 134, 136 can fracture to produce four pieces for every slip segment as shown in FIGS. 15-16.

Some slips may be designed to run in small enough casing to produce slip pieces of a desirable size if the slip segments 128 fracture into only two pieces. However, it may be preferred for each slip segment 128 to fracture into four pieces regardless of the size casing in which the slips 40 are run. It may be that some of the slip segments 128 do not fracture completely because of strange events but the complete fracturing of any slip segment increases the drillability of the slips 40, 42 and is thus of considerable advantage. At the end of relative movement between the slips 40, 42 and expanders 44, 46, the upper end of the well tool 32 parts along a necked down area 148 so the connection 58 and sleeve 56 can be pulled out of the well 10.

When it is time to drill up the well tool 32, a bit or mill on the bottom of coiled tubing or on the bottom of a work string is run into the well 10. The bit is rotated and advanced into engagement with the tool 32 thereby drilling up the sleeve 56 part of the mandrel 30, and the reaction ring 54. The bit is typically small enough to pass through the expanded slip pieces and can drill on the upper expander 44. When enough of the upper expander 44 is drilled up, the pieces from the slips 40 are no longer jammed against the casing 18 whereupon the slip pieces are circulated out of the well 10 by liquid pumped down the coiled tubing or down the work string.

The slip pieces created by fracturing the slips 40 may preferably be small enough and light enough to be circulated out of the well 10 without further reduction in size. Circulation can be down through a coiled tubing or conventional tubing string and up in the annulus between the tubing and casing 18 or circulation can be down in the annulus between a tubing and casing strings and up inside the tubing. The upward velocity needed to circulate the slip pieces out of the well depends on the density of the circulating liquid or gas and properties of the slip pieces, i.e. their cross-sectional size and weight. The pieces of the slip segments can be as small and as light as possible, consistent with maintaining a grip on the inner casing wall. In well tools of increased expansibility, the pieces may preferably weigh less than one ounce and, in well tools of standard expansibility, the pieces may preferably weigh less than ¾ ounce or even one half ounce. Cast iron pieces of these sizes are readily circulated out of the well 10 at typical pumping volumes. Irregular as they are, pieces of the slip segments are not stable during upward movement as a sphere might be. The slip pieces will likely tumble during movement inside the well 10.

Most wells are completed using a water based completion liquid inside the casing string 18. A typical completion liquid is 2% by weight KCl in water or 2% by weight KCl in water with some HCl and having a density of about 9#/gallon. An upward velocity sufficient to circulate the slip pieces upwardly is less than about 400 feet/minute in a 9#/gallon completion liquid. In most situations, normal pumping volumes produce upward velocities of less than about 200 feet/minute is adequate to circulate the slip pieces out of the well 10 without further reduction in size. In a typical example, pumping four barrels per minute downwardly through 2" O.D. coiled tubing produces an upward velocity of about 360 ft/minute inside 4½" O.D. 13.5#/foot casing having an I.D. of 3.925". It is recognized that not all slips segments might not fracture into two or four pieces. However, reduction of some of the slip segments into smaller pieces will allow the smaller pieces to be easily circulated out of the well 10 thereby facilitating drilling up the well tool 32. In actual field situations, a screen or basket on the return line recovers large numbers of slip segments without further reduction in size than created by the weakened zones in the slips.

Figure 17:
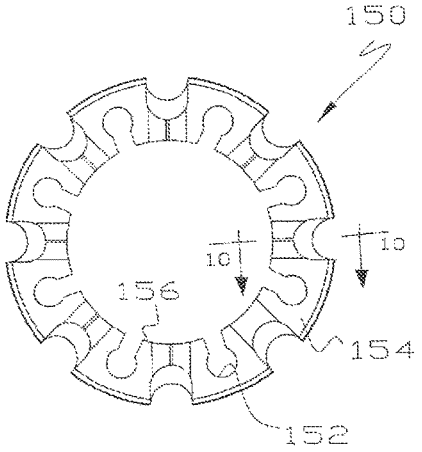
FIG. 17 is an end view, similar to FIG. 8, of another embodiment of a set of slips.

Referring to FIG. 17, there is illustrated another embodiment of a set of slips 150. The slips 150 may differ from the slips 40 in the shape of the passage 152 through the slip body. The passage 152 is a groove opening through the tapered section, through one end 154 and through a central passage or side 156 of the slip body.

Figure 3:
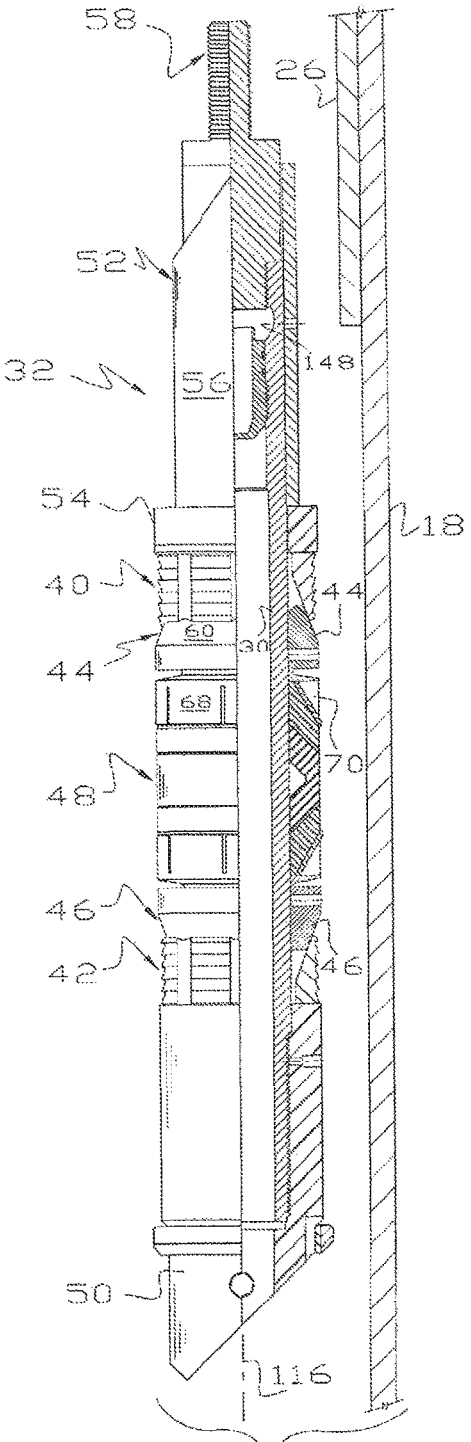
FIG. 3 is a view, partly in cross-section, of a settable well tool.

Referring to FIG. 18, there is illustrated another embodiment of a set of slips 160 comprising a series of individual elongate unitary metal slip segments 162 which can be more-or-less identical and which extend about the periphery of a mandrel even though only three are shown in FIG. 18. The slip segments 162 can be more-or-less identical to the segments 128 except the segments 162 are separate and independent. Some or all of the slip segments 162 include a plane or zone of weakness 164 running parallel to an axis 166 of the slips 160 and axially of a tool of which FIG. 3 is an example. This may be accomplished by the provision of a passage 168 extending through the slip segments 162. Some or all of the slip segments 162 include a plane or zone of weakness 170 extending transverse to the axis 166. The segments 162 can be individually mounted in the manner of the slips 47 and restrained in any suitable manner, as by the provision of frangible wire, frangible pins or other suitable means. In use, the slips 160 operate in much the same manner as the slips 47 except there is no requirement for the slips to break into parallel segments since the segments 162 start out as independent elements. In other words, the slip segments 162 fracture along the zones of weakness into at least two and preferably four or more slip pieces.

One process of working over a horizontal well to frac between old perforations/fractures will now be described in conjunction with FIGS. 1 and 2. Casing patches 26 are run into the casing 18 adjacent each set of existing perforations 22 and set, usually by expanding the casing patch 26 into permanent engagement with the inside of the casing. This may seal off all or selected ones of the old perforations. A new set of perforations 28 is created near the end of the horizontal leg 14 of the well 10 and first set of new perforations are fraced to produce a new fracture 30. A bridge plug 32 is run into the casing 18 past one or more casing patches 26 to a location above the new fracture 30 and then set against the casing 18 thereby isolating the new fracture. A second new set of perforations 28 is created nearer the surface of the well 10 and then traced to produce a second new fracture. A bridge plug 32 is run into the casing 18 past one or more casing patches to a location above the second new fracture and then set against the casing 18 thereby isolating the new fracture. This process is repeated until the desired number of new fractures are created, typically more than five. The bridge plugs 32 are then drilled up with a bit or mill on the bottom of coiled tubing or on the bottom of a tubing string. Because the slips 40, 42 are broken into so many pieces, the bridge plugs 32 can be quietly drilled up. This is most unusual because multiple east iron bridge plugs of the prior art that are capable of passing through casing patches cannot be drilled up by coiled tubing units. Even if one cast iron bridge plug could be drilled up, a second cast iron bridge plug cannot be drilled up because of debris from the first bridge plug and the worn character of the bit.

In one example, a set of slips 40 having an O.D. of 4.25" was designed to run in a tool of conventional expansibility inside unobstructed 5½" casing weighing between 17-26#/foot, meaning that the casing I.D. is in the range of 4.892-4.548". The slips 40 had ten grooves 124, 126 providing ten slip segments 128. The weight of the slips 40 was 1 pound 7.3 ounces, meaning that each slip segment 128 weighed about 2.3 ounces and each of the slip pieces, after setting, weighed in the range of from less than about ½ ounce to about ¾ ounce, averaging 0.58 ounces. Slip pieces of this size can easily be circulated, out of a horizontal or vertical well without further reduction in size by drilling.

Sets of exemplary slips for conventional normally expansible well tools are found in Table II:

TABLE II

| size of casing | O.D. of slips | I.D. of slips | weight of slips | number of segments | ave wt of segments | number of pieces | ave wt of pieces |
|---|---|---|---|---|---|---|---|
| 4½" | 3.45" | 2.02" | 20.8 oz | 8 | 2.60 oz | 8 | 2.60 oz |
| 5½" | 4.25" | 2.85" | 34.0 oz | 8 | 4.25 oz | 8 | 4.25 oz |

Sets of exemplary slips for improved slips for normally expansible tools are found in Table III:

TABLE III

| size of casing | O.D. of slips | I.D. of slips | weight of slips | number of segments | ave wt of segments | number of pieces | ave wt of pieces |
|---|---|---|---|---|---|---|---|
| 4½" | 3.45" | 2.02" | 16.0 oz | 10 | 1.6 oz | 40 | .40 oz |
| 5½" | 4.25" | 2.85" | 24.0 oz | 10 | 2.4 oz | 40 | .60 oz |

Sets of slips of exemplary slips for improved slips for extended reach or increased expansibility tools are found in Table IV:

TABLE IV

| size of casing | O.D. of slips | I.D. of slips | weight of slips | number of segments | ave wt of segments | number of pieces | ave wt of pieces |
|---|---|---|---|---|---|---|---|
| 4½" | 3.00" | 1.55" | 29.0 oz | 6 | 4.83 oz | 24 | 1.21 oz |
| 5½" | 3.90" | 2.53" | 32.0 oz | 8 | 4.00 oz | 32 | 1.00 oz |

The number of slip segments, in the slips can vary as desired. As larger diameter slips are made, there can be mere grooves 124, 126 and thus more slip segments 128.

In an example of the expansibility of a settable well tool described herein, a horizontal well was drilled in Rio Blanco County, Tex. and 5" O.D., 23#/foot casing cemented therein. Casing of this size has a nominal I.D. of 4.044". It appears that minor dog legs, or direction changes, in the path of the well bore at the transition of vertical to horizontal, known as the curve or heel, caused the casing to be deformed so the interior of the casing was partially restricted to an extent where conventional 3.85-3.92" O.D. composite bridge plugs could not be forced through the heel. Because the I.D. of this heavy wall 5" casing is only 4.044", a bridge plug for nominal 4½" casing could, be run into the well. A total of six 3.25" O.D. bridge plugs of the type disclosed herein were run through the heel into the horizontal leg of the well with no apparent dragging. In the process of fracing a hydrocarbon formation to create a series of fractures, all six bridge plugs were set against, the casing. At the end of the fracing operation, all of the bridge plugs were drilled up in one bit run to allow hydrocarbon production upwardly in the well. The bridge plugs met all of the required performance expectations during all stages of completing the well. The alternative to the well owner was to redrill the well at a cost above $4,000,000.

Although the slips 40 are particularly adapted for use in horizontal wells, it is apparent that an increase in drillability is desirable for settable well tools used in vertical wells. Thus, slips that are fractured in many pieces are likewise advantageously used in vertical wells thereby increasing the drillability of settable well tools.

The great majority of horizontal oil or gas wells are completed through 4½", 5", or 5½" casing. Standard composite settable tools, for casing strings of these sizes, are capable of expanding, as defined below, about 10%. Extended reach tools or increased expansibility tools have the capability of expanding at least 15% and can preferably expand greater than 20%. The disclosed settable tool is capable of movement between a retracted position and an expanded position gripping the inner casing wall of these size casing strings. The expansibility of the disclosed well tools may be calculated as:

$$\%\ \text{expansibility}=(\text{exp. O.D.}-\text{ret. O.D.})/\text{ret. O.D.}\times 100$$

where exp. O.D., is the expanded outer diameter of the tool and ret. O.D. is the retracted outer diameter of the tool. The O.D. of the packer or rubber element of settable tools is typically slightly larger, e.g. 0.030", than the O.D. of the slips to prevent the slips from snagging some obstruction in a well. Thus, Table V shows the percent expansibility of the tools of Tables II-IV, as follows:

TABLE V

| expansibility of tools | | | | |
|---|---|---|---|---|
| | slip O.D. | retracted tool O.D. | maximum expanded tool O.D. | % expansibility |
| normally expansible tools of Tables II and III | | | | |
| 4½" | 3.00" | 3.25" | 4.10" | 9.3% |
| 5" | 3.82" | 4.12" | 4.60" | 11.6% |
| 5½" | 4.25" | 4.55" | 5.05" | 10.9% |
| extended reach tools of Table IV | | | | |
| 4½" | 3.00" | 3.25" | 4.10" | 24.2% |
| 5" | 3.60" | 3.75" | 4.60" | 21.1% |
| 5½" | 3.88" | 4.18" | 5.05" | 20.8% |

Of course, it may be desirable to provide two models for each casing size, one for relatively thin wall pipe and one for relatively thick wall pipe. This can have an effect on the desired expansibility of any particular tool.

Although this invention has been disclosed and described in its preferred forms with a certain degree of particularity, it is understood that the present disclosure of the preferred forms is only by way of example and that numerous changes in the details of operation and in the combination and arrangement of parts can be resorted to without departing from the spirit and scope of the invention as hereinafter claimed.

I claim:

1. A settable isolation tool for fracing past at least one casing patch within 4½ inch to 5½ inch outer diameter (O.D.) casing in a horizontal leg of a hydrocarbon well, the tool comprising:

a plurality of a mandrel with a longitudinal axis;

expanders around the mandrel, each expander having a frustoconical section;

a plurality of slips around the mandrel, each slip having a surface complementary to an expander frustoconical section, being in a retracted slip position for running the tool past the casing patch and being movable radially outward by an expander to an expanded slip position for engagement with the casing when the tool is past the casing patch;

the mandrel, expanders and slips each sized and configured so the tool in the tool's retracted position has an O.D. in a range sufficient to pass through 4½" to 5½" O.D. casing and is small enough so the tool can be run through and past the casing patch within the casing in the horizontal leg;

the mandrel, expanders and slips each comprised of materials strong enough so the tool can be expanded and set, and used in isolating and fracing in the horizontal leg past the casing patch;

the mandrel, expanders and slips each sized and configured so after the retracted tool is past the casing patch, the tool can be expanded to an O.D. large enough to set the tool into gripping engagement with an unpatched section of the casing, so the tool can isolate an upper zone above the tool from a lower zone below the tool and the upper zone fraced in isolation from the lower zone, the expanded tool having a maximum expanded tool O.D. at least 20% larger than the retracted tool's O.D.;

the mandrel, expanders and slips each comprised of materials drillable with a single coiled tubing bit run in the horizontal leg past the casing patch after the tool is expanded and set, the mandrel and expanders being of drillable materials selected from the group consisting essentially of aluminum, aluminum alloys, copper, copper alloys, resins and composite materials; and;

the slips being configured to produce pieces small enough and light enough to be circulated out of the horizontal leg and the well by fluid having an upward velocity of 200 feet/minute, so hydrocarbons can be produced from a fraced zone in the horizontal leg;

the mandrel and expanders being of drillable materials selected from the group consisting essentially of aluminum, aluminum alloys, copper, copper alloys, resins and composite materials; and wherein three or more such tools can be serially run past one or more casing patches in the horizontal leg, expanded and set, used in isolating and fracing in the horizontal leg; and then the two or more such tools drilled out with a single coiled tubing bit run, producing tool pieces small enough and light enough to be circulated out of the horizontal leg and the well by fluid having an upward velocity of 200 feet/minute so hydrocarbons can be produced from the horizontal leg and the well.

2. The tool of claim 1 wherein each of five or more such tools can be serially run past one or more casing patches in the horizontal leg, expanded and set, used in isolating sections of the casing and in fracing; and then the five or more such tools are configured to be drilled out with a single coiled tubing bit run, producing slip pieces small enough and light enough to be circulated out of the horizontal leg by a completion fluid having an upward velocity of 200 feet/minute so hydrocarbons can be produced from the horizontal leg and the well.

3. The tool of claim 1 wherein the slip has an interior side and an exterior side, at least some of the exterior side is hardened or comprised of metal and hard enough to maintain the tool in gripping engagement with the casing during setting and fracing, the tool being drillable in the horizontal leg past the casing patch with a single coiled tubing bit run, the slip disintegrating into slip pieces small enough to be circulated out of the well by a completion liquid in the casing having an upward velocity of 200 feet/minute.

4. The tool of claim 1 wherein each slip has zones of weakness and the expansion of each slip to set the tool fractures each slip at least in part on multiple zones of weakness to produce at least two small slip pieces which are small enough and light enough to be circulated out of the well by a completion fluid having an upward velocity of 400 feet/minute.

5. The tool of claim 1 wherein the O.D. of the tool in the expanded position is at least 25% greater than the O.D. of the tool in the retracted position.

6. The tool of claim 1 wherein the slips disintegrate into slip pieces having an average weight of 1.21 ounces or less.

7. The tool of claim 1 wherein the slips disintegrate into slip pieces having an average weight of one ounce or less.

8. The tool of claim 1 wherein the slips disintegrate into slip pieces having an average weight of ¾ ounce or less.

9. The tool of claim 1 wherein the slips disintegrate into slip pieces having an average weight of ½ ounce or less.

10. The tool of claim 1 wherein the slip pieces are small enough and light enough to be circulated out of the well by fluid in the casing having an upward velocity of 300 feet/minute.

11. The tool of claim 1 wherein the slip pieces are small enough and light enough to be circulated out of the well by fluid in the casing having an upward velocity of 400 feet/minute.

12. The tool of claim 1 wherein the expander has an interior side and an exterior side, the exterior side is hardened or comprised of metal and hard enough so when the expanders expand the slips the expander does not extrude between expanded slip gaps enough to prevent the expanders from setting the slips against the casing, and the exterior side is thin and drillable enough so the expander is drillable in the horizontal leg past the casing patch with a single coiled tubing bit run into expander pieces small enough to be circulated out of the well by fluid in the casing having an upward velocity of 200 feet/minute.

13. The tool of claim 1 wherein the outer surface of the expander is harder than a Rockwell B hardness of 50.

14. The tool of claim 1 wherein;

an exterior side of the expanders is hard enough so when the expanders expand the slips, the expanders do not extrude between expanded slip gaps enough to prevent the expanders from setting the slips into gripping engagement with the casing for use in isolating and fracing, the expanders being drillable enough to be drillable in the horizontal leg with a single coiled tubing bit run;

each slip is large enough so when the tool is past the casing patch and the slips are expanded in the casing, the slips set against the casing for use in isolating and fracing in the casing horizontal leg, each slip weighing between 29 and 32 ounces; and the exterior side of the expanders are hard enough, and the slips are large enough, so the expanded tool's maximum O.D. is at least 20% larger than the retracted tool's O.D., the tool can set against the casing in a horizontal leg and can be used in isolating and fracing in the horizontal leg.

15. The tool of claim 1 wherein the casing in the horizontal leg has a 4.5 inch O.D., the O.D. of the retracted slips is 3 inches or less and the O.D. of the tool in the retracted position is 3.25 inches or less, so the tool can be run past the casing patch; and the tool is expandable to an extended position of an O.D. of 4.1 inches or more, so the tool can be set against the casing.

16. The tool of claim 1 wherein the casing in the horizontal leg has a 5 inch O.D., the O.D. of the retracted slips is 3.6 inches or less and the O.D. of the tool in the retracted position is 3.75 inches or less, so the tool can be run past the casing patch; and the tool is expandable to an extended position of an O.D. of 4.6 inches or more, so the tool can be set against the casing.

17. The tool of claim 1 wherein the production casing has a 5.5 inch O.D., the O.D. of the retracted slips is 3.88 inches or less and the O.D. of the tool in the retracted position is 4.18 inches or less, so the tool can be run past the casing patch; and the tool is expandable to an extended position of 5.05 inches or more, so the tool can be set against the casing.

18. The tool of claim 1 wherein the slips are of cast iron and include zones of weakness to facilitate creating slip pieces which are small enough and light enough to be circulated out of the well by a completion fluid having an upward velocity of 200 feet/minute.

19. The tool of claim 1 wherein each retracted slip is comprised of multiple slip pieces held on the tool when the tool is in the tool's retracted position, the multiple slip pieces being expandable outward by the expander.

20. A set of at least three settable isolation tools for fracing the horizontal leg of a hydrocarbon well, the horizontal leg having at least first, second and third casing patches, comprising:

a first tool, a second tool, and a third tool, each tool comprising:

a mandrel with a longitudinal axis;

at least one expander around the mandrel;

the mandrel and expander are each comprised to be drillable with coiled tubing when the tool is in gripping engagement with the casing in the horizontal leg so when the tool is drilled out the tool will produce mandrel and expander pieces small enough to be circulated out of the well so hydrocarbons can be produced from the well by fluid having an upward velocity of 300 feet/minute;

at least one slip around the mandrel, movable radially outward by the expander from a retracted position to an expanded position for setting the tool against the casing;

the mandrel, expander and slip each located, sized, and configured so the tool in the retracted position has an O.D. small enough so the tool can pass through the casing patch within the casing in the horizontal leg, namely, in a range sufficient to pass through casing of 4½" to 5½" O.D. when the tool is run into the horizontal leg;

the mandrel, expander and slip each located, sized, and configured so when the retracted tool is past the casing patch in the horizontal leg, the tool can foe expanded to an O.D. large enough to set the tool into a gripping engagement with the casing and isolate an upper zone above the tool from a lower zone below the tool, the expanded tool having a maximum expanded tool O.D. at least 15% larger than the retracted tool's O.D.;

the tool is comprised, sized and configured to be run in its retracted position past the casing patch in the horizontal leg, and expanded into gripping engagement with an unpatched section of the casing, to isolate the upper zone from the lower zone, so the upper zone can be fraced in isolation from the lower zone, and the tool thereafter drilled out with coiled tubing, the expanded and drilled out tool producing tool pieces small enough to be circulated out of the horizontal leg to permit hydrocarbons to be produced from the horizontal leg; and wherein, three or more such tools, serially run past one or more patches in the horizontal leg, can be expanded in the horizontal leg to isolate zones in the horizontal leg and used in serial fracing, each tool drillable enough so the two or more tools can be drilled out in a single coiled tubing bit run, the single drilling out coiled tubing bit run producing pieces small enough to be circulated out of the horizontal leg so hydrocarbons can be produced from the horizontal leg by fluid having an upward velocity of 300 feet/minute;

the first tool can be run past the first, second and third casing patches, and expanded into gripping engagement within an unpatched section of the casing, to isolate a zone in the horizontal leg above the first tool from a zone below the first tool to permit the first tool's upper zone to be fraced in isolation from the first tool's lower zone;

the second tool can be run past the first and second casing patches casing patches, and expanded into gripping engagement within an unpatched section of the casing, to isolate a zone in the horizontal leg above the second tool from a zone below the second tool to permit the first tool's upper zone to be fraced in isolation from the second tool's lower zone;

the third tool can be run past the first casing patch, and expanded into gripping engagement within an unpatched section of the casing, to isolate a zone in the horizontal leg above the third tool from a zone below the third tool to permit the first tool's upper zone to be fraced in isolation from the third tool's lower zone; and the set of at least three tools comprised to so the at least three tools can be drilled out with coiled tubing in a single bit run and comprised so their drilled out pieces can be circulated out of the horizontal leg to permit hydrocarbon production from the fraced zones in the horizontal leg.

21. The tool of claim 20 wherein the set of tools comprises at least five isolation tools useful for fracing the horizontal leg of a well with casing and at least first, second, third, fourth and fifth casing patches in the horizontal leg;

each tool capable of isolating a zone above the tool from a zone below the too; to permit the upper zone to be fraced in isolation from the lower zone; and the set of at least five tools comprised to be drillable enough so the tools can be drilled out in a single coiled tubing bit run, and each tool produce pieces small enough so the drilled out pieces can be circulated out of the horizontal leg so hydrocarbons can be produced from the horizontal leg.

22. The tool of claim 20 wherein the O.D. of the tools in their expanded position is at least 20% greater than the O.D. of the tools in their retracted position.

23. The tool of claim 20 wherein the slip pieces are small enough to be circulated out of the well by fluid in the casing having an upward velocity of 200 feet/minute.

24. A method for isolating and fracing at least three zones in a horizontal leg of a hydrocarbon well having at least three casing patches within casing in the horizontal leg, and producing hydrocarbons from the well, comprising:

providing at least three isolation tools to the well, each tool comprising:

a mandrel with a longitudinal axis;

expanders around the mandrel, each expander having a frustoconical section;

slips around the mandrel, each slip having a surface complementary to an expander frustoconical section, being in a retracted slip position for running the tool Past the casing patch and being movable radially outward by an expander to an expanded slip position for engagement with the casing when the tool is past the casing patch;

the mandrel, expanders and slips each sized and configured so the tool in the tool's retracted position has an O.D. in the range sufficient to pass through 4½" to 5½" O.D. casing and is small enough so the tool can be run through and past the casing patch within the casing in the horizontal leg;

the mandrel, expanders and slips each comprised of materials strong enough so the tool can be expanded and set, and used in isolating and fracing in the horizontal leg past the casing patch, the materials being selected from the group consisting essentially of aluminum, aluminum alloys, copper, copper alloys, resins and composite materials;

the mandrel, expanders and slips each sized and configured so after the retracted tool is past the casing patch, the tool can be expanded to an O.D. large enough to set the tool into gripping engagement with an unpatched section of the casing, so the tool can isolate an upper zone above the tool from a lower zone below the tool and the upper zone fraced in isolation from the lower zone, the expanded tool having a maximum expanded tool O.D. at least 20% larger than the retracted tool's O.D.;

at least one slip has zones of weakness and the expansion of the slip to set the tool fractures the slip at least in part on at least a zone of weakness to produce slip pieces which are individually smaller and lighter than the slip;

the mandrel, expanders and slips each comprised of materials drillable with a single coiled tubing bit run in the horizontal leg past the casing patch after the tool is expanded and set, and used in isolating and fracing in the horizontal leg to produce tool pieces small enough and light enough to be circulated out of the horizontal leg and the well by fluid having an upward velocity of 300 feet/minute so hydrocarbons can be produced from the horizontal leg and the well, the mandrel and expanders being of drillable materials selected from the group consisting essentially of aluminum, aluminum alloys, copper, copper alloys, resins and composite materials; and wherein the three or more such tools can be serially run past one or more casing patches in the horizontal leg, expanded and set, used in isolating and fracing in the horizontal leg; and then the two or more such tools drilled out with a single coiled tubing bit run, producing tool pieces small enough and light enough to be circulated out of the horizontal leg and the well by fluid having an upward velocity of 300 feet/minute so hydrocarbons can be produced from a fraced zone in the horizontal leg;

running the first tool past the first, second and third casing patches, expanding the first tool into gripping engagement within an unpatched section of the casing to isolate a first zone in the horizontal leg and fracing the first zone;

running the second tool past the first and second casing patches, expanding the second tool into gripping engagement within an unpatched section of the casing to isolate a second zone in the horizontal leg and fracing the second zone;

running the third tool past the first casing patch, expanding the third tool into gripping engagement within an unpatched section of the casing to isolate a third zone in the horizontal leg and fracing the third zone;

drilling out the at least three tools from the horizontal leg in a single coiled tubing bit run, the drilling out producing pieces small enough to be circulated out of the horizontal leg by fluid having an upward velocity of 300 feet/minute;

circulating the tools'pieces out of the horizontal leg, the circulating out of the pieces enabling hydrocarbon production from the first, second and third fraced zones in the horizontal leg; and producing hydrocarbons from the first, second and third fraced zones in the horizontal leg.

25. The method of claim 24 further comprising using at least five isolation tools in the horizontal leg of a well with casing and at least first, second, third, fourth and fifth casing patches in the horizontal leg;

running each tool past at least one casing patch, expanding each tool into gripping engagement within an unpatched section of the casing to isolate a zone in the horizontal leg and fracing the isolated zones to produce at least five fraced zones;

drilling out the at least five tools from the horizontal leg in a single bit run, the drilling out producing pieces small enough to be circulated out of the horizontal leg by fluid having an upward velocity of 300 feet/minute;

circulating the tools' pieces out of the horizontal leg, the circulating out of the pieces enabling hydrocarbon production from the first, second and third fraced zones in the horizontal leg; and producing hydrocarbons from the at least five fraced zones in the horizontal leg.

26. A settable isolation tool for fracing past at least one casing patch within 4½ inch to 5½ inch O.D. casing in a horizontal leg of a hydrocarbon well, the tool comprising:

a mandrel with a longitudinal axis;

a plurality of expanders around the mandrel, each expander having a frustoconical section;

a plurality of slips around the mandrel, each slip having a surface complementary to an expander frustoconical section, being in a retracted slip position for running the tool past the casing patch and being movable radially outward by art expander to an expanded slip position for engagement with the casing when the tool is past the casing patch;

the mandrel, expanders and slips each sized and configured so the tool in the tool's retracted position has an O.D. in the range sufficient to pass through 4½" to 5½" O.D. casing and is small enough so the tool can be run through and past the casing patch within the casing in the horizontal leg;

the mandrel, expanders and slips each comprised of materials strong enough so the tool can be expanded and set, and used in isolating and fracing in the horizontal leg past the casing patch;

the mandrel, expanders and slips each sized and configured so after the retracted tool is past the casing patch, the tool can be expanded to an O.D. large enough to set the tool into gripping engagement with an unpatched section of the casing, so the tool can isolate an upper zone above the tool from a lower zone below the tool and the upper zone fraced in isolation from the lower zone, the expanded tool having a maximum expanded tool O.D. at least 25% larger than the retracted tool's O.D.;

each slip has zones of weakness and the expansion of each slip fractures each slip at least in part on multiple zones of weakness, the slips configured to disintegrate to produce at least two small slip pieces which are small enough and light enough to be circulated out of the well by fluid having an upward velocity of 300 feet/minute;

the mandrel, expanders and slips being comprised of materials drillable with a single coiled tubing bit run in the horizontal leg past the casing patch after the tool is expanded and set, and used in isolating and fracing in the horizontal leg to produce tool pieces small enough and light enough to be circulated out of the horizontal leg and the well by fluid having an upward velocity of 300 feet/minute so hydrocarbons can be produced from the horizontal leg and the well, the mandrel and expanders being selected from the group consisting essentially of aluminum, aluminum alloys, copper, copper alloys, resins and composite materials; and wherein five or more such tools can be serially run past one or more casing patches in the horizontal leg, expanded and set, used in isolating and fracing in the horizontal leg and then the two or more such tools drilled out with a single coiled tubing bit run, producing tool pieces small enough and light enough to be circulated out of the horizontal leg and the well by fluid having an upward velocity of 300 feet/minute so hydrocarbons can be produced from the horizontal leg and the well.

* * * * *